US007134840B2

(12) United States Patent
Vogel

(10) Patent No.: US 7,134,840 B2
(45) Date of Patent: Nov. 14, 2006

(54) ROTOR SYSTEM FOR A REMOTELY CONTROLLED AIRCRAFT

(76) Inventor: Heribert Vogel, Mozartstr. 1/1, 71711 Steinheim (DE)

( * ) Notice: Subject to any disclaimer, the term of this patent is extended or adjusted under 35 U.S.C. 154(b) by 0 days.

(21) Appl. No.: 10/656,080

(22) Filed: Sep. 5, 2003

(65) Prior Publication Data

US 2004/0198136 A1 Oct. 7, 2004

Related U.S. Application Data

(63) Continuation of application No. PCT/EP02/02154, filed on Feb. 28, 2002.

(30) Foreign Application Priority Data

Mar. 6, 2001 (DE) ..... 101 10 659
May 16, 2001 (DE) ..... 101 25 734

(51) Int. Cl.
*A63H 27/04* (2006.01)
*B64C 11/44* (2006.01)
*B64C 13/20* (2006.01)

(52) U.S. Cl. ..... 416/3; 416/61; 416/155; 416/162; 416/163; 416/164; 416/168 R; 446/37; 446/38; 446/129

(58) Field of Classification Search ..... 416/155, 416/159, 162–164, 168 R, 3, 61; 244/190, 244/17.25; 446/36–38, 129, 132
See application file for complete search history.

(56) References Cited

U.S. PATENT DOCUMENTS 5,628,620 A 5/1997 Arlton

FOREIGN PATENT DOCUMENTS

| | | | |
|---|---|---|---|
| DE | 29919462 U1 | | 5/1999 |
| EP | 0727350 A1 | | 8/1996 |
| GB | 2149372 A | | 6/1985 |
| JP | 3-16897 A | * | 1/1991 |
| WO | WO-85/02349 A1 | * | 6/1985 |

* cited by examiner

*Primary Examiner*—Christopher Verdier
(74) *Attorney, Agent, or Firm*—Michael O. Scheinberg; Hilgers, Bell & Richards LLP

(57) ABSTRACT

A remotely controllable flying machine, such as a remote control ultralight helicopter, has at least one rotor blade (104), the pitch (α) of which may be adjusted. The adjustment of the pitch (α) of the at least one rotor blade is achieved by means of a force, such as a torsion force directly applied to the rotation axis of the rotor blade. The force is generated by a magnetic field, variable by the electrical control of at least one coil (196) which is not part of an electric motor.

15 Claims, 7 Drawing Sheets

Fig. 1A
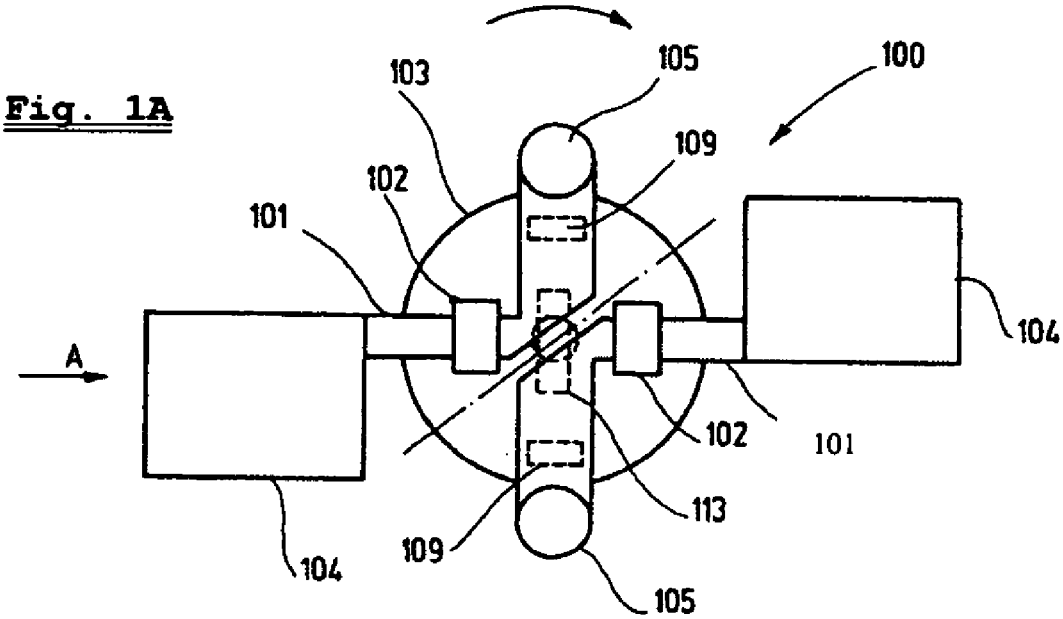
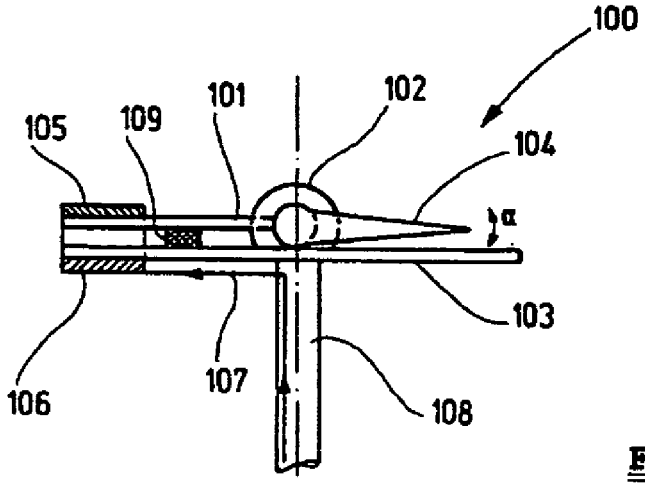
Fig. 1B

Fig. 3A
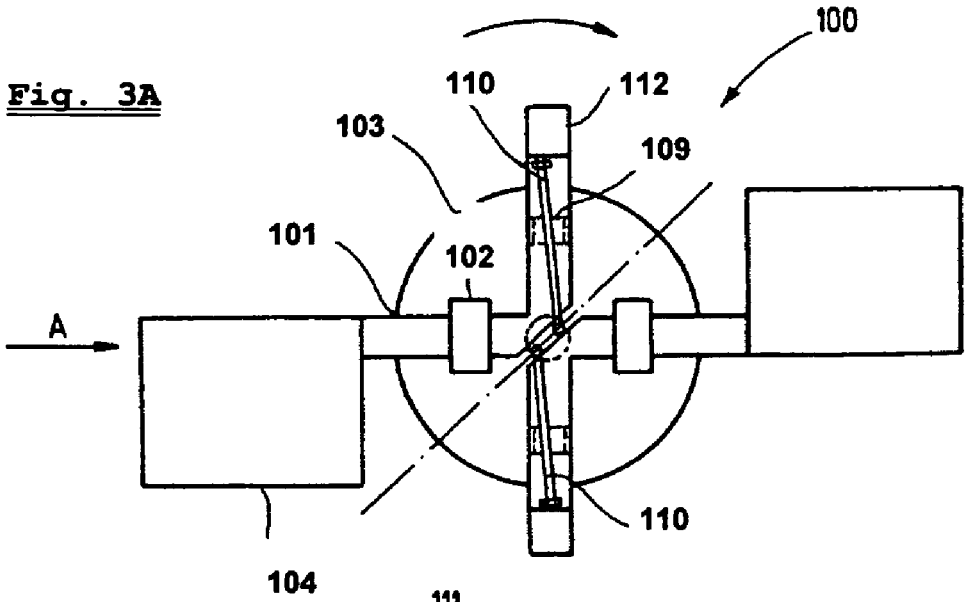
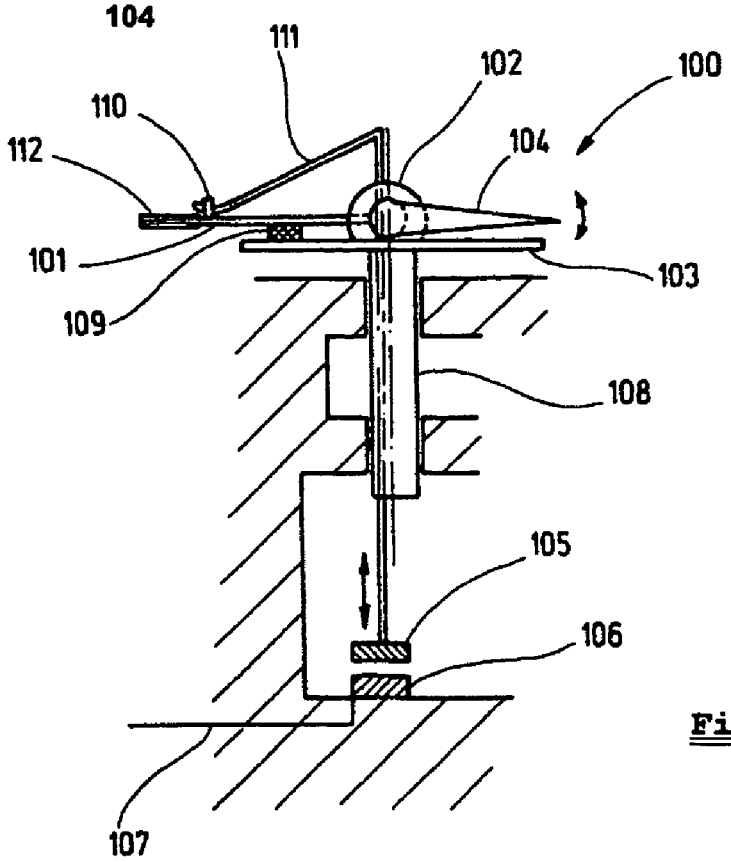
Fig. 3B

Fig. 5A
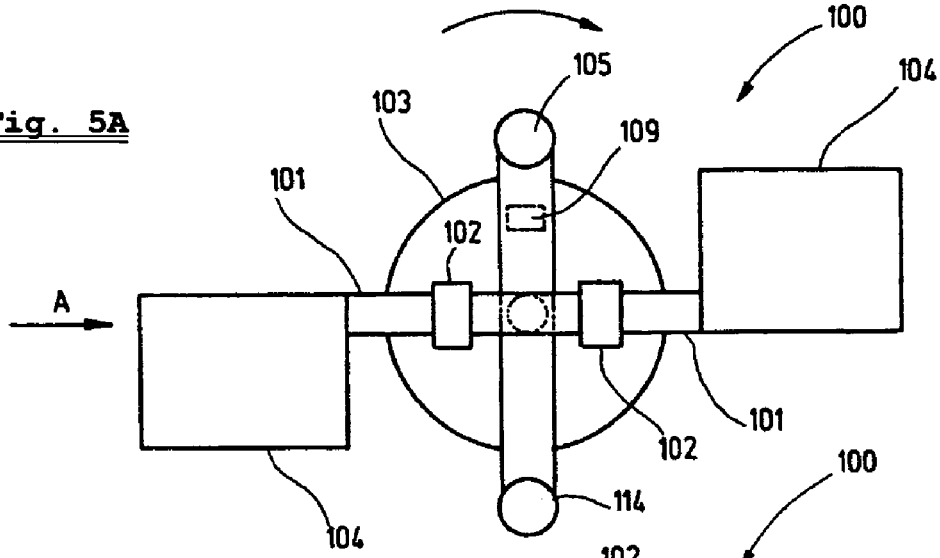
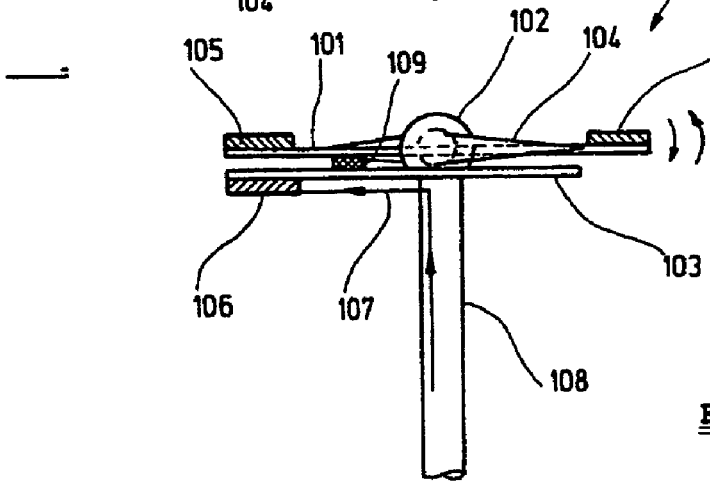
Fig. 5B

ROTOR SYSTEM FOR A REMOTELY CONTROLLED AIRCRAFT

RELATED APPLICATIONS

This application is a continuation of International Patent Application PCT/EP02/02154, which was filed on 28 Feb. 2002 designating the U.S. and which was not published in English.

TECHNICAL FIELD

The present invention relates to a remotely controlled aircraft, in particular a remotely controlled ultralight model helicopter, having at least one rotor blade whose angle of incidence can be adjusted.

PRIOR ART

By way of example, in the context of model helicopters, it is known for the lift and aircraft pitch/roll of the main rotor to be controlled via a complex linkage which is connected to servo motors. Two solutions are normally used, in particular, for driving the tail rotor. In the first solution, the tail rotor is connected to the main drive via a gearbox which is controlled by a servo motor, via an optional clutch or coupling and via an output drive shaft. In the second solution, the tail rotor is driven by a separate motor. The first solution is normally used when the main drive is an internal combustion engine. A second internal combustion engine, provided only for driving the tail rotor, would be too heavy, in particular in the region of the tail rotor. An electric motor requires a complex generator or heavy rechargeable batteries. The second solution is used in particular for electrically powered models since only electric motors can be used at the moment as the drive for the tail rotor since only a small amount of power is required. Furthermore, it is known for the gyro system which controls the tail rotor thrust for stabilization about the main rotor shaft (or further three-dimensional axes such as the aircraft pitch or roll for example) to be provided as a separate system in its own housing, which can be connected to the overall system.

The described design embodiments mean that conventional structures are relatively heavy since, in addition to the design features mentioned, they are optimized in particular with regard to stiffness and strength so as to survive a possible crash without suffering major damage. Any additional weight in turn requires more powerful and hence necessarily heavier motors and an energy supply for them, for example rechargeable batteries. This has led to a situation in which, until now, no model helicopters with a weight of <200 grams have been commercially available, for example. The helicopters which reach this limit are still based on conventional technology and are often marketed as so-called indoor helicopters. However, experience has shown that those learning to fly them, in particular, have problems in successfully controlling the model inside rooms, so that the expression indoor in fact means hall-type rooms. When crashes occur, the model is often damaged despite having a robust construction. This is because of the weight, which is still quite high, and the inertia forces, associated with this, of the model helicopter. In order to control the lift of the main rotor such that it is variable (collective blade pitch, aircraft pitch and roll), conventional main rotor control systems control the angle of incidence of the rotor blades in a variable manner via servo motors, swashplate, Hiller paddles and so on. Although a number of prototypes of model helicopters are known whose weight is down to 40–50 grams, these prototypes are, however, also based on the conventional technology, are correspondingly complex to manufacture, and are thus not suitable for large-scale production.

The invention is based on the object of specifying a remotely controlled aircraft, in particular a remotely controlled ultralight model helicopter, which can be produced at low cost, can be assembled relatively easily and is lighter in weight than known remotely controlled aircraft.

ADVANTAGES OF THE INVENTION

The remotely controlled aircraft according to the invention is based on the generic prior art in that the angle of incidence of the at least one rotor blade is adjusted, without using an electric motor with rotating elements, by means of a force, in particular a torsion force which is introduced directly into the rotation shaft of the rotor blade, and which is produced via a magnetic field which can be varied by the electrical drive from at least one coil. The solution according to the invention means that there is no need for the servo motors that are used in the prior art, thus achieving lower production costs and a reduced weight. In preferred embodiments, the coil is driven such that the desired angle of incidence is produced when the forces acting on the rotor blade are in equilibrium with respect to the angle of incidence. This is advantageously achieved in the form of a control process.

The at least one coil is preferably driven in a pulsed manner. This allows the angle of incidence to be controlled or regulated, for example, completely digitally.

Provision is preferably made for the force which causes the adjustment of the angle of incidence of the at least one rotor blade to be transmitted as a torsion force to the rotor blade via a connecting bracket which is hinged on the at least one rotor blade such that the position of the connecting bracket defines the angle of incidence of the at least one rotor blade. In this context, it is, for example, feasible for one connecting bracket to be associated with one rotor blade or for each rotor blade to be associated with one connecting bracket. The last-mentioned solution is used in particular when two or more rotor blades are provided, whose angles of incidence can be varied independently of one another.

In this context, provision is preferably made for the connecting lever to be able to pivot about an axis at right angles to the rotor rotation shaft. In this case, the pivoting axis preferably cuts the rotor main shaft.

For certain embodiments of the aircraft according to the invention, provision can be made for the at least one coil to be arranged on a rotor plate which is connected to a rotor shaft. An embodiment such as this means that in many cases there is no need for push rods or the like, which are used for transmitting forces.

In particular, provision is preferably made in this context for the at least one coil to be electrically driven via sliding contacts. These sliding contacts may, for example, be arranged on a rotor plate, on which one or more rotor blades is or are mounted.

In particular it is also possible to provide in the context mentioned above for at least one permanent magnet, which makes a contribution to the magnetic field, to be arranged on at least one connecting lever. A permanent magnet such as this can also act as a counterbalance and, via the centrifugal force, can contribute to one or more rotor blades being moved to a predetermined position with respect to the angle of incidence, for example to a rest position or to a position in which a force equilibrium exists with respect to the angle of incidence. In this context, if required, it is also possible to provide suitable stop elements, for example between a rotor plate and a connecting bracket.

The present invention also relates to embodiments in which provision is made for the force which results in the adjustment of the angle of incidence of the at least one rotor blade being transmitted via at least one push rod. A push rod such as this is preferably arranged in the area of the rotation shaft of the rotor, which has at least one rotor blade, and may, for example, extend into the fuselage of the aircraft, in order to interact there with elements that do not rotate.

In particular, it is also possible to provide in this context for the at least one push rod to be hinged on the connecting lever. This may be achieved, for example, via an angled section of the push rod and an eye which is provided on the connecting lever. Depending on the arrangement of the eye along the radially guided part of the connecting lever, this thus also results in a stop between the angled section of the push rod and the connecting bracket, thus defining a maximum angle of incidence.

Additionally or alternatively, it is possible to provide for at least one permanent magnet, which makes a contribution to the magnetic field, to be arranged on the at least one push rod. Without being restricted to this, this embodiment is particularly useful when the push rod interacts with non-rotating elements in the fuselage of the aircraft.

In particular, it is also possible to provide in the context explained above for the at least one coil to be arranged on a non-rotating element of the aircraft, adjacent to the at least one permanent magnet. In this case, solutions are feasible, for example, in which the permanent magnet is arranged at one axial end of the push rod above the coil, or in which the coil is arranged radially adjacent to the permanent magnet, with respect to the push rod.

In certain embodiments of the aircraft according to the invention, provision can be made for the aircraft to have at least two rotor blades whose angles of incidence can be adjusted independently of one another, and for each of the at least two rotor blades to have at least one associated coil. If the angles of incidence of the rotor blades can be adjusted independently of one another by means of an appropriate drive to the respective coils, this results in particularly advantageous flying characteristics.

In particular, it is also possible to provide in this context for a flexible elastic connecting element to connect the connecting brackets in pairs such that centrifugal forces which act at right angles to the rotation axes are cancelled out, and an additional restoring force is produced which moves the rotation axes to the original position.

Furthermore, for the remotely controlled aircraft, it is possible to provide for the two connecting levers which are connected to the rotor blades and whose angles of incidence can be adjusted independently of one another to be connected to one another via a flexible elastic element.

It is also possible to provide for a lift component (collective blade pitch) which is coaxial with respect to a main rotor shaft to be controlled by driving in each case at least two coils, each of which is associated with one rotor blade, such that the angles of incidence of the at least two rotor blades are varied in the same sense. This variation or adjustment of the angles of incidence in the same sense may, for example, be produced by applying a DC voltage to the at least one coil, in particular a pulsed DC voltage, which can be produced by completely digital means.

Additionally or alternatively, it is also possible to provide for a lift component (aircraft pitch and/or roll) which is not coaxial with respect to a main rotor shaft to be controlled by driving in each case at least two coils, each of which is associated with one rotor blade, such that the angles of incidence of the at least two rotor blades are varied in opposite senses. This can be achieved, for example, by the two rotor blades having pulses of opposite polarity repeatedly applied, synchronized to a specific time within the period duration of the main rotor. In this case, the duration of these pulses governs the magnitude of the aircraft pitch/roll forces. In this context, it is advantageous to achieve collective blade pitch and aircraft pitch/roll drive simultaneously for the collective blade pitch and aircraft pitch/roll pulses not simply to be superimposed with aircraft pitch/roll priority since this can result in interactions between collective blade pitch and aircraft pitch/roll.

The present invention also relates to embodiments in which provision is made for the remotely controlled aircraft to have at least two rotor blades whose angles of incidence can be adjusted in a coupled manner. For this purpose, by way of example, a single connecting bracket may be used, which transmits the force that is required to adjust the angles of incidence. Corresponding coupling of the rotor blades allows particularly simple structures, which are thus light and cost-effective.

Provision can be made in all the embodiments of the aircraft according to the invention for a lift component (collective blade pitch) which is coaxial with respect to a main rotor shaft to be controlled by applying a DC voltage, in particular a pulsed DC voltage, to the at least one coil, which is associated with at least one rotor blade.

Additionally or alternatively, it is possible to provide for a lift component (aircraft pitch and/or roll) which is not coaxial with respect to a main rotor shaft to be controlled by applying an AC voltage, in particular a pulsed AC voltage, to the at least one coil, which is associated with at least one rotor blade. In situations in which both the coaxial lift component and the non-coaxial lift component are adjusted via pulsed voltages, the respective pulse durations may differ and may be defined, for example, by a control circuit.

In particular, it is also possible to provide in a preferred manner in the context mentioned above for the period of the AC voltage to be synchronized to the speed of rotations, which is applied to the at least one coil, of the at least one rotor blade. Such synchronization results in low-vibration operation.

It is also possible to provide for a lift component (collective blade pitch) which is coaxial with respect to a main rotor shaft and a lift component (aircraft pitch and/or roll) which is not coaxial with respect to a main rotor shaft to be controlled in a superimposed manner. In order to maintain a maximum aircraft pitch/roll control capability and nevertheless to provide independent collective blade pitch and aircraft pitch/roll drive, it is possible in this context to use, for example, a pulsed sequence which is varied for the collective blade pitch such that the vertical lift remains constant when aircraft pitch/roll pulses are added. This may be done, for example, by lengthening the collective blade pitch pulses.

Particularly preferred embodiments of the aircraft according to the invention provide for the at least one coil to be driven completely digitally. This is done in particular when a digital control device is used.

In addition or alternatively, it is also possible to provide for a pulse width correction to be carried out when driving the at least one coil with a simultaneous collective blade pitch drive and aircraft pitch/roll drive.

Any kit which is suitable for producing a remotely controlled aircraft, in particular an ultralight model helicopter, according to an embodiment of the invention falls within the scope of protection of the associated claims.

DRAWINGS

The invention will be explained in more detail, in the following text with reference to the associated drawings, in which:

FIG. 1A shows a plan view of a first embodiment of a main rotor of the aircraft according to the invention;

FIG. 1B shows a side view of FIG. 1A indirection A;

FIG. 3A shows a plan view of a second embodiment of a main rotor of the aircraft according to the invention;

FIG. 3B shows a side view of FIG. 3A in direction A;

FIG. 5A shows a plan view of a third embodiment of a main rotor of the aircraft according to the invention;

FIG. 5B shows a side view of FIG. 5A in direction A;

DESCRIPTION OF THE EXEMPLARY EMBODIMENTS

Figure 2A:
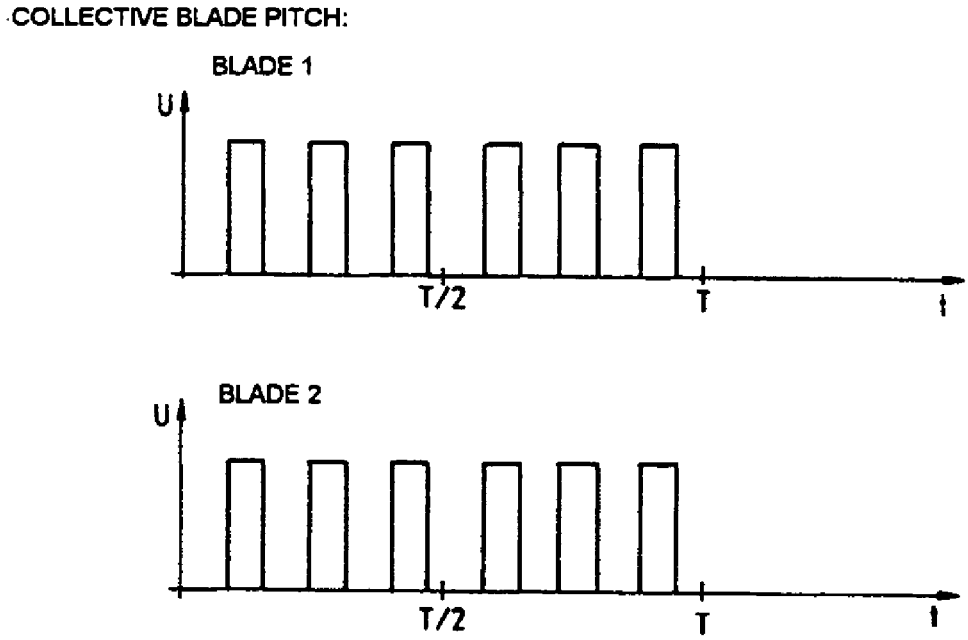
FIGS. 2A to 2C show examples of electrical drive profiles for adjusting angles of incidence.

The exemplary embodiment will be described in the following text for an ultralight model helicopter, by way of example.

FIGS. 1A and 1B shows a plan view and side view of a first embodiment of a main rotor of the aircraft according to the invention, Two coils 106, which are electrically connected via tap contacts (which are not illustrated), are mounted symmetrically with respect to the main rotor shaft 102 on a main rotor plate 103, which is connected to a main rotor shaft 108 which runs in bearings. Two rotary bearings 102 are likewise mounted on the main rotor plate 103 and each have a connecting bracket 101 mounted in them, to whose opposite ends a permanent magnet 105 and a rotor blade 104 are attached. The permanent magnet 105 is arranged such that a direct current 107 through the coils 106 leads to deflection of the connecting bracket 101 and hence to a change in the angle of incidence $\alpha$ of the rotor blades. The change in the angle of incidence $\alpha$ also results in a change in the speed of the air which is accelerated downward or upward by the rotor blades 104 as the rotor head rotates, and hence also results in a change in the lift produced by the structure. If the coil current 107 is interrupted again, the centrifugal force on the connecting bracket 101 and on the permanent magnet 105 which is attached to it, as well as the forces which act on the rotor blades 104 counteract the acceleration of the air in the eflection, so that the connecting bracket 101 is reset back to a neutral position. Overshooting is largely prevented by the damping characteristics of the rotor blades 104.

Overshooting can be virtually completely prevented by fitting a damping but flexible stop 109 on the main rotor plate 103 underneath the connecting bracket 101. By fitting a flexibly elastic element 113 which connects the connecting brackets 101, centrifugal forces which act radially with respect to the rotation axes of the rotor blades and are caused by the connecting brackets 101 can be absorbed thus reducing the friction in the rotary bearings 102. This design allows the following measures to be used to control a main rotor 100. Application of a direct current 107 to the coil 106 makes it possible to permanently change the deflection of the rotor blades 104 and hence the magnitude of the lift (collective blade pitch) which is coaxial with respect to the main rotor shaft 108. By applying an AC voltage, whose period is synchronized to the speed of rotations of the main rotor shaft 108, a constant lift vector can be produced, which is no longer coaxial with respect to the main rotor shaft 108 but comprises a coaxial lift component (collective blade pitch) and a horizontal drive (aircraft pitch and roll) at right angles to it. The structure is thus provided with the same degrees of freedom of movement as conventional main rotor control systems, but the direct drive components have considerably less inertia and can thus be actuated more quickly than servobased rotor control systems.

Figure 2B:
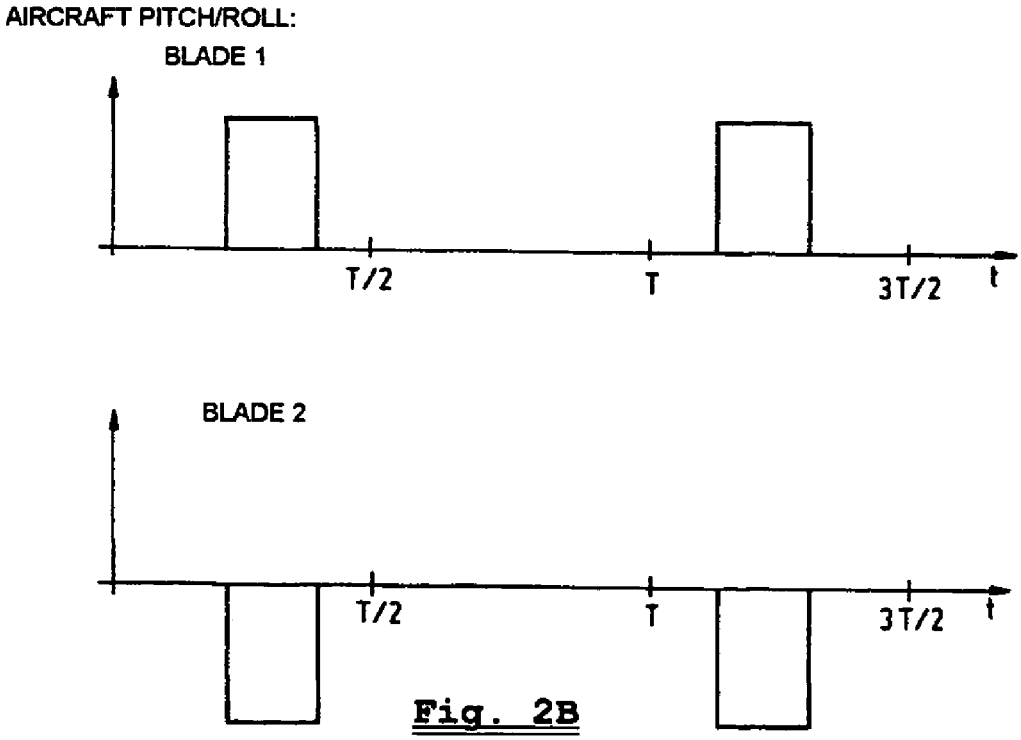
Figure 2C:
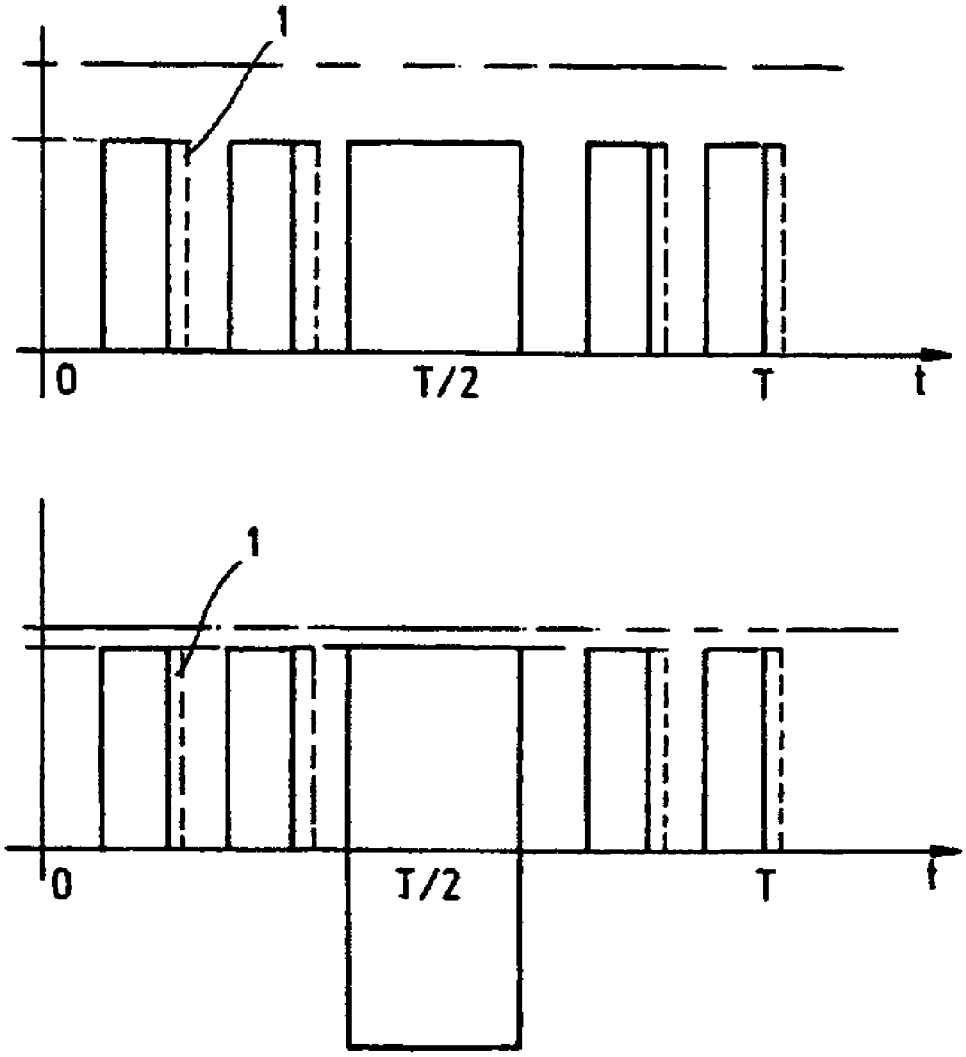

FIGS. 2A–2C show examples of electrical drive profiles for adjusting angles of incidence. The collective blade pitch drive is provided by a uniform pulse sequence for both rotor blades, as is shown in FIG. 2A. In order to produce smooth, low-vibration running, the pulse sequence should have a period duration which is small in comparison to the time which is required to move a rotor blade 104 from the rest/normal position to maximum pitch and back to the rest/normal position. The aircraft pitch/roll drive can be provided by the two rotor blades 104 repeatedly having pulses of opposite polarity applied to them in synchronism with a specific time within the period duration T of the main rotor 100, as is shown in FIG. 2B. The duration of these pulses governs the intensity of the aircraft pitch/roll forces. In order to achieve collective blade pitch and aircraft pitch/roll actuation at the same time, the collective blade pitch and aircraft pitch/roll pulses should not simply be superimposed with aircraft pitch/roll priority, since this leads to interactions between the collective blade pitch and the aircraft pitch/roll. This is due to the fact that, in the case of a rotor blade in which the collective blade pitch and aircraft pitch/roll pulses are in the same direction, the aircraft pitch/roll effect is considerably less than in the case of a rotor blade in which the collective, blade pitch and aircraft pitch/roll pulses are in opposite directions. In order to ensure the maximum aircraft pitch/roll control capability and nevertheless to provide independent collective blade pitch and aircraft pitch/roll drive, the pulse sequence for the collective blade pitch must be changed such that the vertical lift remains constant when the aircraft pitch/roll pulses are added. This can be achieved relatively easily by lengthening the collective blade pitch pulses applied to the rotor blades 104, as is illustrated by the dashed line in FIG. 2C.

FIGS. 3A and 3B shows a plan view and a side view of a second embodiment of a main rotor of the aircraft according to the invention. In order to avoid sliding contacts, which in some circumstances are susceptible to defects, for producing an electrical connection to the coils 106, the coils 106 are mounted in the non-rotating part of the helicopter in the embodiment illustrated in FIGS. 3A and 3B. The connection between the rotor blades 104 and the permanent magnets 105 is in this case provided via connecting brackets 101, eyes 110 and push rods 111, on which the permanent magnets 105 are mounted. The vertical force which is introduced into the connecting bracket 101 through the push rod 105 via the eye 110 leads to the already described deflection of the connecting bracket 101 and to the described control response, that is to say to the adjustment of the angle of incidence $\alpha$. In the embodiment illustrated in FIGS. 3A and 3B, the resetting of the rotor blades 104 is ensured by providing weights 112 instead of the weight of the permanent magnet 105, which is located virtually on the rotation axis.

Figure 4:
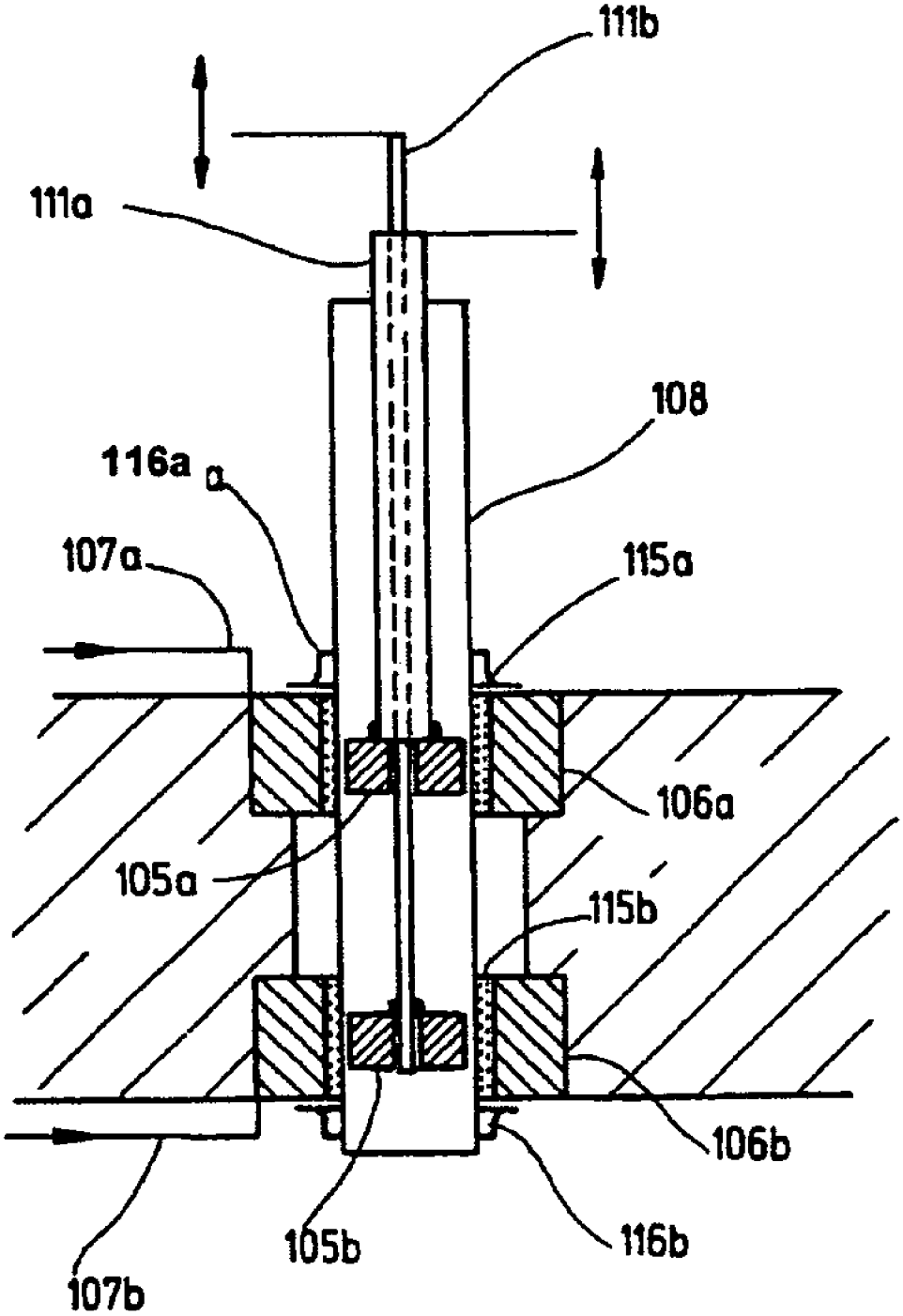
FIG. 4 shows a side view of a push rod arrangement for transmitting a force for adjusting an angle of incidence.

FIG. 4 shows a side view of a push rod arrangement for transmitting a force for adjusting an angle of incidence. The illustration shown in FIG. 4 can in particular be combined with the embodiment illustrated in FIGS. 3A and 3B. According to the illustration in FIG. 4, the two permanent magnets 105*a*, 105*b* are attached to the ends of two push rods 111*a*, 111*b*, which can easily be moved in one another. The thin push rod 111*b* is driven by magnetic force, by the permanent magnet 105*b* which is attached to its end, by a current flow through the coil 106*b*, which is arranged coaxially with a sliding bearing 115*b*. This applies iii an analogous manner to the thicker push rod 111*a*, which is in the form of a tube and which guides the thinner push rod 111*b* in the axial direction. This structure has the major advantages that the bearing and the force introduction into the permanent magnets 105*a*, 105*b* can be provided in the same plane, which results in considerable cost, advantages in the implementation of the design. The arrangement of the push rods 111*a*, 111*b* is free of parasitic centrifugal forces, which would have to be neutralized in a complex manner by means of counterweights. By choosing a sufficiently large distance between the bearings 115*a*, 115*b*, it is also simple to decouple the magnetic effect of the coils 106.

FIGS. 5A and 5B shows a plan view and side view of a third embodiment of a main rotor of the aircraft according to the invention. The embodiment illustrated in FIGS. 5A and 5B is a variant of the main rotor control which can be implemented more easily, but which nevertheless has aircraft pitch/roll control capabilities. According to the illustration in FIGS. 5A and 5B, a coil 106, which is electrically connected via tap contacts (which are not illustrated), is mounted on the main rotor plate 103, which is connected to the main rotor shaft 108. Two rotary bearings 102 are likewise mounted on the main rotor plate lost in which one, and only one, connecting bracket 101 is mounted, which rigidly connects the two rotor blades 104 to one another and to whose transverse cantilever ends a permanent magnet 105 and a counterweight 114 are fit. The permanent magnet 105 is arranged such that a direct current 107 through the coil 106 leads to deflection of the connecting bracket 101 and hence to a change in the angle of incidence $\alpha$ of the rotor blades 104. In contrast to the embodiment shown in FIGS. 1A and 1B, the rotor blades 104 are, however, always deflected in opposite senses. If the coil current 107 is interrupted again, the centrifugal force of the connecting bracket 101, of the permanent magnet 105 which is attached to it and of the counterweight 114 counteracts the deflection, so that the connecting bracket 101 is reset back to a neutral position. Overshooting can be virtually completely avoided by fitting a fixed stop 109, which is not sprung, to the main rotor plate 103 underneath the connecting bracket 101. This principle can be utilized as follows for main rotor control: a force vector which is not coaxial with respect to the main rotor shaft 108 can be produced by applying an AC voltage whose period is synchronized to the speed of rotations of the main rotor shaft 108. The embodiment which is illustrated in FIGS. 5A and 5B is a considerably simplified variant of the embodiment shown in FIGS. 1A and 1B. Instead of driving the collective blade pitch and aircraft pitch/roll, the embodiment which is I illustrated in FIGS. 5A and 5B allows only the aircraft pitch/roll drive for the rotor blades 104. This embodiment is therefore dependent on the blade geometry of the rotor blades 104 producing a specific amount of lift depending on the speed of rotations, and hence corresponding to a fixed blade pitch angle. With regard to the pulse sequence for driving, the description of the aircraft pitch/roll drive can be used in conjunction with the embodiment shown in FIGS. 1A and 1B, as is illustrated in FIG. 2B.

Since the collective blade pitch pulses are not superimposed, there is no need for any pulse correction, as described in conjunction with the embodiment shown in FIGS. 1A and 1B.

Figure 6A:
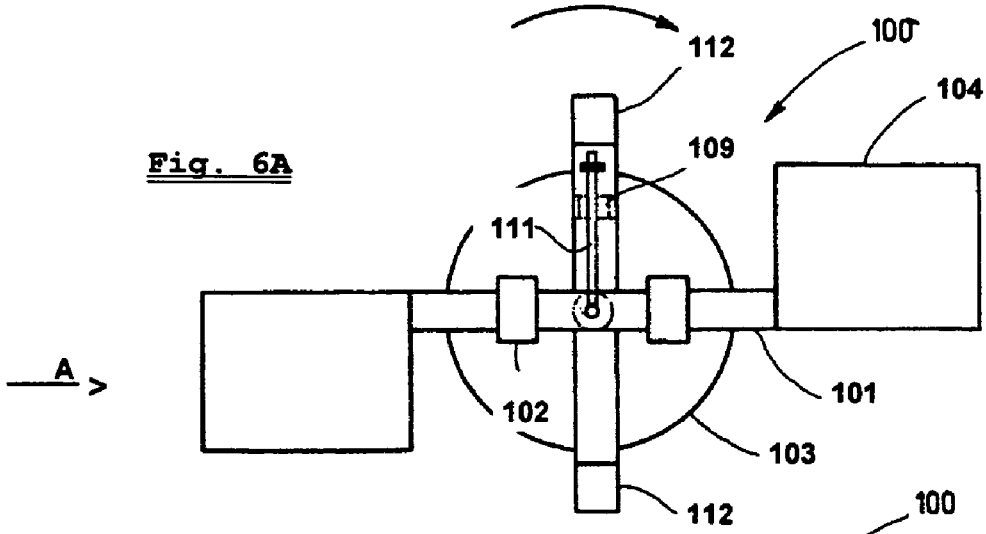
FIG. 6A shows a plan view of a fourth embodiment of a main rotor of the aircraft according to the invention.
Figure 6B:
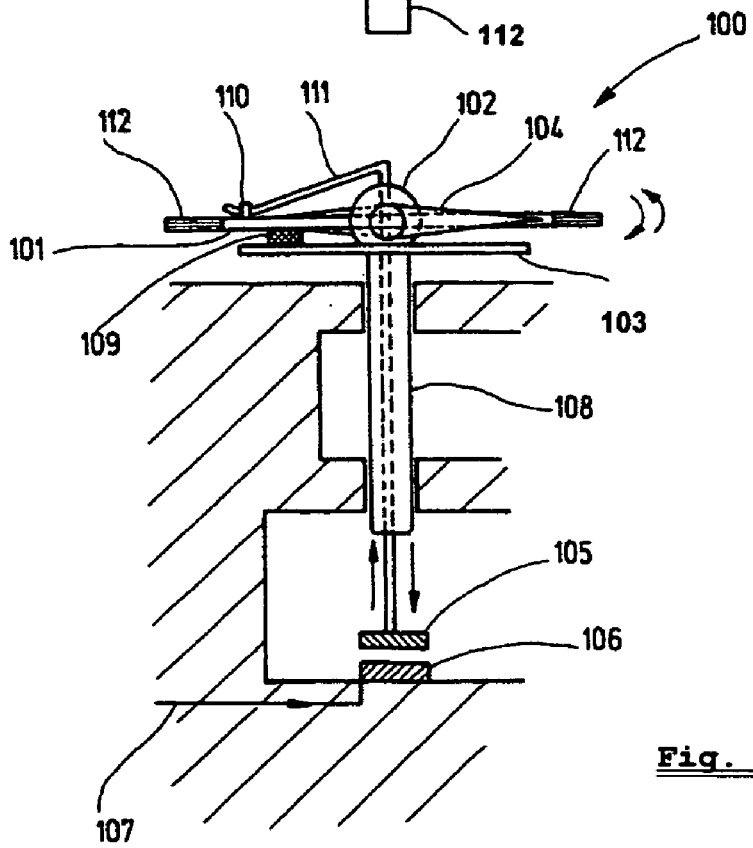
FIG. 6B shows a side view of FIG. 6A in direction A.

FIGS. 6A and 6B shows a plan view and side view of a fourth embodiment of a main rotor of the aircraft according to the invention. In order to avoid sliding contacts, which in some circumstances are susceptible to defects, for producing an electrical connection to the coil 106 as shown in FIGS. 5A and 5B, the coil 106 shown in the illustration in FIGS. 6A and 6B is mounted in the non-rotating part of the helicopter. The connection between the rotor blades 104 and the permanent magnets 105 is in this case produced via the connecting bracket 101, the eye 110 and the (angled) push rod 111, to which the permanent magnet 105 is attached. The vertical force which is introduced by the push rod 111 via the eye 110 and the connecting bracket 101 leads to the already described deflection of the connecting bracket 101 and to the described control response. The resetting of the rotor blades 104 is ensured by replacing the weight of the permanent magnet 105, which in practice is located on the rotation axis, by weights 112 which are provided on the outer areas of the connecting bracket 101. The damping of a damping element can be reinforced by mounting one of the counterweights 112 for overcoming the unbalance on the main rotor plate 103, and not on the connecting bracket 101. This means that the centrifugal forces produced by the individual weights 112, which are not compensated for, lead to increased bearing friction in the rotary bearings 102, which results in a damping effect with respect to deflection of the rotor blades 104. However, the increased bearing friction in some circumstances also leads to increased wear to the bearings 102. The embodiment shown in FIGS. 6A and 6B corresponds essentially to the embodiment shown in FIG. 4, with one of the push rods 111 with the associated arrangement comprising the permanent magnet 105 and the coil 106 optionally being omitted.

The present invention, in particular in conjunction with the features which are explained only in the description of the figures and may all be regarded as being significant for achievement of the object, is distinguished by the possible guiding structure, actuating elements which act completely digitally, and novel concepts for the integrated physical structure. This allows model helicopters to be produced at low cost, which are lighter in weight by a factor of about 10–20 than model helicopters based on conventional technology, with production costs that are the saute or less. The small dimensions of the components as made possible by the invention mean that the bending torques which often have a destructive effect in the event of crashes are significantly less with respect to the strength of the components, so that the models based on the invention are at least just as robust as model helicopters constructed using conventional technology. The lighter weight also means that energy which is stored in the rotors during operation is considerably reduced, so that the risk of injury and damage is also significantly reduced, in comparison to conventional model helicopters, which are considerably heavier. The invention provides a remotely controlled aircraft which is particularly light in weight, weighing only a few grams, for example, when using currently available drive motors, but which nevertheless is reliable and can be subjected to loads. Furthermore, it is simple to convert the aircraft to other variants by virtue of a modular structure.

Although all the features relating to the following aspects are not claimed in the original application documents, the following aspect elements, in particular, are regarded as being significant to the invention:

fully digital drive for the main rotor via magnetic slides fully digital drive for the tail rotor via digitally driven clutch or coupling elements fully integrated electromechanical gyro system newly designed landing gear,which operates on the spring-damper principle, with an integrated clamping apparatus, for example for the helicopter structure complete integration of all the actuating elements and measurement modules required for the function described above on one board, which can be clamped between the landing gear and the structure and carries out self supporting functions.

The invention claimed is:

1. A remotely controllable aircraft comprising:

at least one rotor blade, the angle of incidence (a) of which is adjustable, characterized in that adjustment of the angle of incidence (a) of said at least one rotor blade is performed by using at least one lever acting on the rotor blade by a force produced through a magnetic field which can be varied through the electric drive of at least one coil;

at least one push rod, characterized in that the force which results in the adjustment of the angle of incidence ($\alpha$) of the at least one rotor blade is transmitted via the at least one push rod; and at least one permanent magnet, which makes a contribution to the magnetic field, arranged on the at least one push rod.

2. The remotely controllable aircraft as claimed in claim 1, characterized in that the magnetic field is produced by the at least one permanent magnet and by the at least one coil.

3. The remotely controllable aircraft as claimed in claim 2, characterized in tat the at least one coil is arranged on a non-rotating element of the aircraft, adjacent to the at least one permanent magnet.

4. The remotely controllable aircraft as claimed in claim 1, characterized in that the at least one coil is driven in a pulsed manner.

5. The remotely controllable aircraft as claimed in claim 1, characterized in that the at least one push rod is hinged on the lever.

6. A remotely controllable aircraft comprising:

at least two rotor blades whose angles of incidence can be adjusted independently of one another;

at least one coil associated with each of the at least two rotor blades;

characterized in that adjustment of the angle of incidence of at least one rotor blade is performed by using at least one lever acting on the rotor blade by a force produced through a magnetic field which can be varied through the electric drive of at least one coil; and two connecting levers which are connected to the rotor blades and whose angles of incidence ($\alpha$) can be adjusted independently of one another are connected to one another via a flexible elastic element.

7. A remote controllable aircraft comprising:

at least two rotor blades whose angles of incidence can be adjusted;

at least two coils, each of which is associated with one rotor blade;

characterized in that adjustment of the angle of incidence (a) of at least one rotor blade is performed by using at least one lever acting on the rotor blade by a force produced through a magnetic field which can be varied through the electric drive of at least one coil; and a lift component which is coaxial with respect to a main rotor shaft is controlled by driving in each case at least two coils, such that the angles of incidence ($\alpha$) of the rotor blades are varied in the same sense.

8. A remotely controllable aircraft comprising:

at least two rotor blades whose angles of incidence can be adjusted;

at least two coils, each of which is associated with one rotor blade;

characterized in that adjustment of the angle of incidence (a) of at least one rotor blade is performed by using at least one lever acting on the rotor blade by a force produced through a magnetic field which can be varied through the electric drive of at least one coil; and a lift component which is not coaxial with respect to a main rotor shaft is controlled by driving in each case at least two coils, such that the angles of incidence ($\alpha$) of the rotor blades are varied in opposite senses.

9. The remotely controllable aircraft as claimed in claim 8, characterized in that the remotely controllable aircraft has at least two rotor blades whose angles of incidence ($\alpha$) can be adjusted in a coupled manner.

10. The remotely controllable aircraft as claimed in claim 8, characterized in that a lift component which is coaxial with respect to the main rotor shaft is controlled by applying a DC voltage to the at least one coil, which is associated with at least one rotor blade.

11. A remotely controllable aircraft comprising at least one rotor blade, the angle of incidence (a) of which is adjustable, characterized in that adjustment of the angle of incidence (a) of said at least one rotor blade is performed by means of at least one lever acting on the rotor blade by a force produced through a magnetic field which can be varied through the electric drive of at least one coil, the at least one rotor blade providing a lift component which is not coaxial with respect to a main rotor shaft and is controlled by applying an AC voltage to the at least one coil, which is associated with at least one rotor blade.

12. The remotely controllable aircraft as claimed in claim 11, characterized in that the period of the AC voltage which is applied to the at least one coil is synchronized to the rotation of the at least one rotor blade.

13. A remotely controllable aircraft comprising at least one rotor blade, the angle of incidence (a) of which is adjustable, characterized in that adjustment of the angle of incidence (a) of said at least one rotor blade is performed by means of at least one lever acting on the rotor blade by a force produced through a magnetic field which can be varied through the electric drive of at least one coil, characterized in that a lift component which is coaxial with respect to a main rotor shaft and a lift component which is not coaxial with respect to the main rotor shaft are controlled in a superimposed manner.

14. The remotely controllable aircraft as claimed in claim 13, characterized in that the at least one coil is driven completely digitally.

15. A kit for producing a remotely controllable aircraft as claimed in claim 13.

* * * * *